US006003726A

United States Patent [19]

Hawkes

[11] Patent Number: 6,003,726

[45] Date of Patent: Dec. 21, 1999

[54] HAND-HELD FEEDER FOR HEADED FASTENERS

[75] Inventor: E. Gerry Hawkes, Woodstock, Vt.

[73] Assignee: Bike Track, Inc., Woodstock, Vt.

[21] Appl. No.: 08/873,426

[22] Filed: Jun. 12, 1997

[51] Int. Cl.[6] ..... A47F 1/04

[52] U.S. Cl. ..... 221/310; 221/307; 221/312 R

[58] Field of Search ..... 221/288, 303, 221/304, 307, 310, 312 R, 312 C, 171, 172; 206/338, 347; 81/57.37; 29/809, 811.2, 813; 193/38; 352/73

[56] References Cited

U.S. PATENT DOCUMENTS

| | | | |
|---|---|---|---|
| 81,404 | 8/1868 | Pierce | 221/172 |
| 532,737 | 1/1895 | Miles | 221/310 |
| 626,987 | 6/1899 | Dineson | 221/307 |
| 688,731 | 12/1901 | Hinds | 221/307 |
| 1,445,795 | 2/1923 | Parker . | |
| 1,556,240 | 10/1925 | Morrissey . | |
| 1,659,763 | 2/1928 | Breithaupt | 221/307 |
| 1,683,328 | 9/1928 | Breithaupt | 221/307 |
| 1,810,460 | 6/1931 | Breithaupt | 221/307 |
| 1,945,144 | 1/1934 | Follett et al. | 221/307 |
| 2,029,444 | 2/1936 | Schiveley | 193/38 |
| 2,041,057 | 5/1936 | Follett et al. | 221/307 |
| 2,122,003 | 6/1938 | Cooper | 221/307 |
| 2,480,764 | 8/1949 | Pennington | 221/307 |
| 2,777,484 | 1/1957 | Groneman . | |
| 3,321,074 | 5/1967 | Marsh . | |
| 3,812,961 | 5/1974 | Merrick et al. . | |
| 4,007,834 | 2/1977 | Borgersen . | |
| 4,199,014 | 4/1980 | Nickle . | |
| 4,359,157 | 11/1982 | Horstmann . | |
| 4,998,452 | 3/1991 | Blum . | |
| 5,143,216 | 9/1992 | Aurtoi et al. . | |

*Primary Examiner*—H. Grant Skaggs
*Attorney, Agent, or Firm*—Cesari and McKenna, LLP

[57] ABSTRACT

A hand-held feeder for fasteners having a head and a shank comprises a handle configured to contain fasteners and a channel extending from the handle, the channel having a free end and a support slit extending from the free end toward the handle. The support slit is wider than the fastener shanks but narrower than the heads, so that when fasteners emerging from the handle encounter the slit, the shanks will drop down through the, slit while the heads remain accessible within the channel. The channel is designed to provide unobstructed access to the heads of fasteners having shanks extending through the slit.

14 Claims, 5 Drawing Sheets

HAND-HELD FEEDER FOR HEADED FASTENERS

BACKGROUND OF THE INVENTION

1. Field of the Invention

The present invention relates to the use of headed fasteners such as screws and nails, and in particular to devices for feeding such fasteners into a use-ready orientation.

2. Description of the Related Art

Automated devices for installing fasteners such as screws and bolts typically utilize feeder mechanisms that place the fasteners into an appropriate orientation for affixation. Frequently, the fasteners are carried on a tape (U.S. Pat. No. 4,199,014) or in a package (U.S. Pat. Nos. 4,007,834 and 1,556,240) for presentation to the automated assembly device, which sequentially drives a fastener into its intended location and advances the carrier to the next fastener.

This approach adds expense (not only in the form of the carrier itself, but in the need to properly attach the fasteners to the carrier), and may not be well-suited to larger fasteners. Furthermore, these types of carriers do not lend themselves well to manual applications, where a user repeatedly installs fasteners by hand. The maneuvers necessary to orient a loose fastener properly for installation can, if repeated persistently, prove fatiguing under the best of conditions. In cold weather, especially if gloves are worn, the handling of individual fasteners—bringing them from a container into position for affixation, and maintaining this position until the fastener is driven—can be particularly awkward and time-consuming.

A need exists, therefore, for a hand-held feeder for fasteners such as screws and nails, and which repeatedly and conveniently delivers fasteners into position for sequential affixation.

DESCRIPTION OF THE INVENTION

Objects of the Invention

It is, accordingly, an object of the invention to provide a feeder for fasteners that facilitates ready, sequential positioning of fasteners over an installation point.

It is another object of the invention to facilitate the sequential feeding of fasteners without special packaging.

It is further object of the invention is to provide a feeder for fasteners that is conveniently used and easily manufactured.

Other objects will, in part, be obvious and will, in part, appear hereinafter. The invention accordingly comprises an article of manufacture possessing the features and properties exemplified in the constructions described herein, all as exemplified in the following detailed description, and the scope of the invention will be indicated in the claims.

Brief Summary of the Invention

In accordance with the invention, a hand-held feeder for fasteners having a head and a shank comprises a handle configured to contain fasteners and a channel extending from the handle, the channel having a free end and a fastener-support slit extending from the free end toward the handle. The support slit is wider than the fastener shanks but narrower than the heads, so that when fasteners emerging from the handle encounter the slit, the shanks drop down through the slit while the heads remain accessible within the channel. The channel is designed to provide the user with unobstructed access to the heads of fasteners having shanks extending through the slit.

The channel and the handle portion of the device may have any of a variety of shapes, so long as the channel defines a generally concave profile having a bottommost region along which the support slit may extend. For example, the channel may have an arcuate or wedge-shaped transverse cross-section. The invention may also incorporate one or more obstructions and/or baffles to regulate the flow of fasteners from the handle portion to the channel.

The device of the present invention may be used with a variety of fasteners including screws, nails, brads, tacks, rivets and the like. In the case of nails, the feeder may comprise means for removably retaining a nail at the free end of the feeder, thereby allowing the user to raise the head of the lead nail for ready hammering.

BRIEF DESCRIPTION OF THE DRAWINGS

The foregoing discussion will be understood more readily from the following detailed description of the invention, when taken in conjunction with the accompanying drawings, in which.

The drawings and components shown therein are not necessarily to scale.

DETAILED DESCRIPTION OF THE PREFERRED EMBODIMENTS

Figure 1:
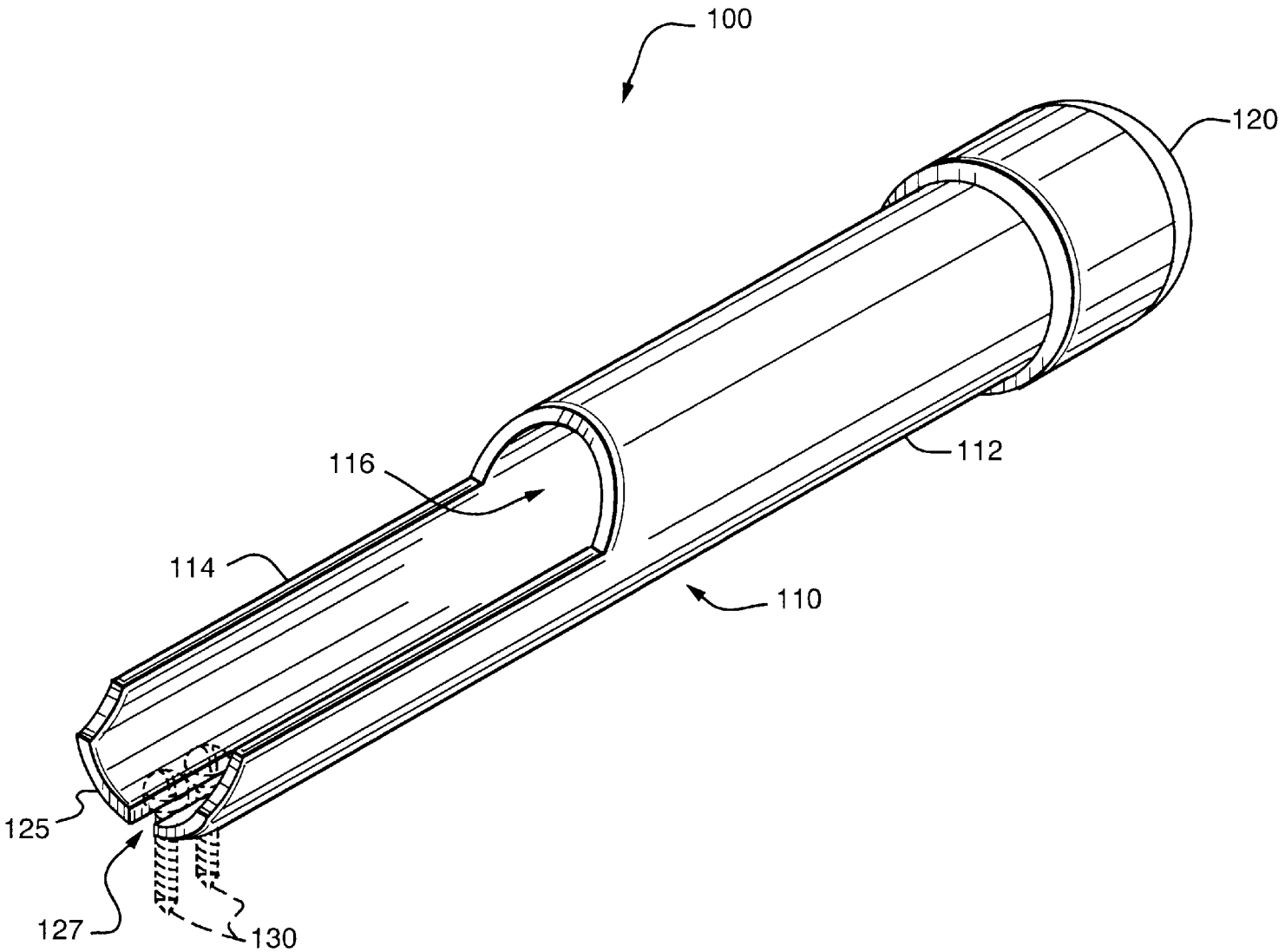
FIG. 1 is an isometric view of a first embodiment of the invention having a arcuate feeding channel.
Figure 2:
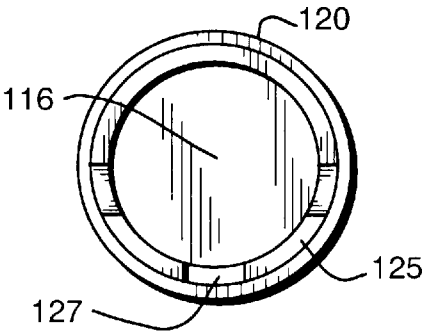
FIG. 2 is an end view of the embodiment shown in FIG. 1.

As shown in FIG. 1, a first embodiment of the present invention, indicated generally at 100, comprises an elongated member 110 having a handle portion 112 and a gutter or channel portion 114. In the illustrated embodiment, handle 112 forms a closed reservoir 116 having a hollow interior terminated by a cap 120 (which may or may not be removable). Reservoir 116 acts as a storage compartment for fasteners. It should be stressed that, while this component of the invention is illustrated in a closed configuration, in principle this is unnecessary; for example, the reservoir 116 may simply be an open extension of channel 114.

Figure 3:
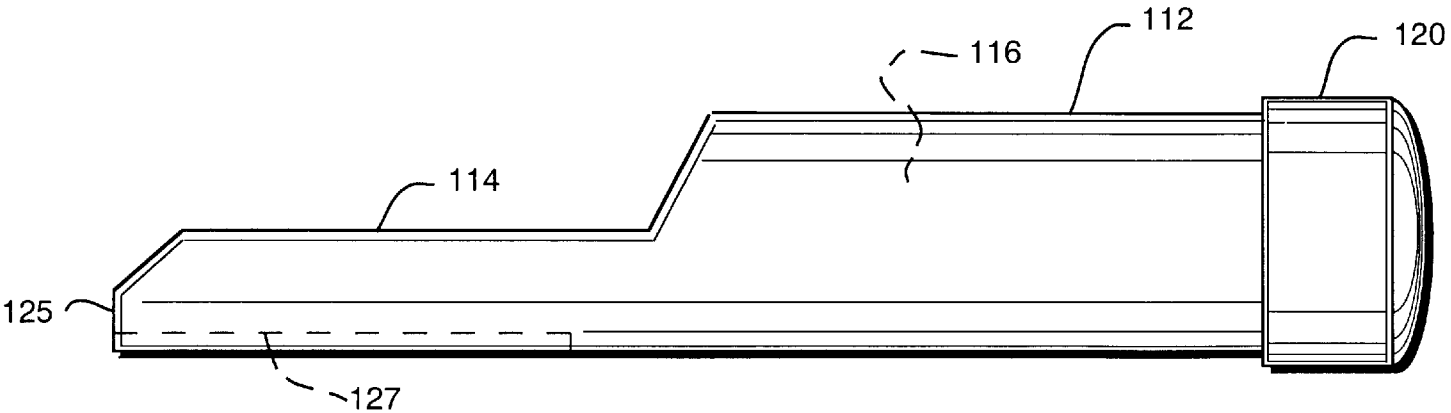
FIG. 3 is a side elevation of the embodiment shown in FIG. 1.

Channel 114 has a free end 125 and a fastener-support slit 127 (see FIGS. 1 and 3) extending longitudinally from the free end 125, and which may span substantially the entire length of channel 114. Slit 127 lies at the bottom of channel 114; its width is greater than that of the fastener shanks, but less than that of the fastener heads. In this way, when the feeder 100 is shaken or tipped toward free end 125, fasteners contained within reservoir 116 slide toward the free end and, when they encounter slit 127, their shanks flip downward through the slit with the heads retained thereover. As a result, and as shown in FIG. 1, a series of fasteners 130 will be arranged in a neat row along slit 127, ready for affixation. The open design of channel 114 provides unobstructed access to the heads of fasteners suspended in slit 127, and also allows the user to regulate the flow of fasteners from reservoir 116 using a thumb or finger placed over the entrance thereto. It may be desirable to bevel the front edge of free end 127 as shown in order to avoid sharp corners.

In the illustrated embodiment, channel 114 has an arcuate transverse cross-section. As discussed below, this shape is not necessary to the function of the invention. Instead, what is important is a generally concave profile having a bottom-most region along which slit 127 may be defined; this configuration ensures that the shanks of fasteners from reservoir 116 will be guided naturally into slit 127 through simple shaking or tilting of the device. Similarly, channel 114 need not be completely open as illustrated; it is sufficient that the driving tool be afforded unobstructed access to to the heads of fasteners having shanks extending through the slit.

The material from which feeder 100 is fabricated is not critical. Ideally it is lightweight for convenient manipulation and handling, but also sufficiently rugged for repeated use with metal fasteners. PVC or other sturdy plastic has been found to be suitable, and indeed, portions of the illustrated embodiment 100 may be conveniently manufactured from, for example, readily available two-inch, schedule 40 PVC piping.

In operation, the user first loads the feeder 100 with fasteners, either by removing end cap 120, or by scooping fasteners into reservoir 116 through the open channel 114 and tipping the feeder 100 toward end cap 120. To employ the feeder, the user tilts the feeder 100 toward free end 125, regulating the flow of fasteners with a finger or thumb if necessary; slight shaking drops fasteners through slit 127. Feeder 100 is then tipped back toward end cap 120 to withdraw from channel 114 fasteners that have not dropped through slit 127. Holding feeder 100 in one hand and a driving tool in the other, the user drives the lead fastener (i.e., the one closest to the free end of slit 127) into its intended location with an appropriate tool, and pulls feeder 100 away so the fastener clears free end 125. The feeder 100 can also be used to aid in the removal of fasteners. As the user removes an installed fastener, feeder 100 is slid into place and used to help draw the fastener out. The feeder 100 is even useful in connection with vertical surfaces by positioning fasteners such as screws into convenient position for attraction by a magnetic driver bit.

Figure 4:
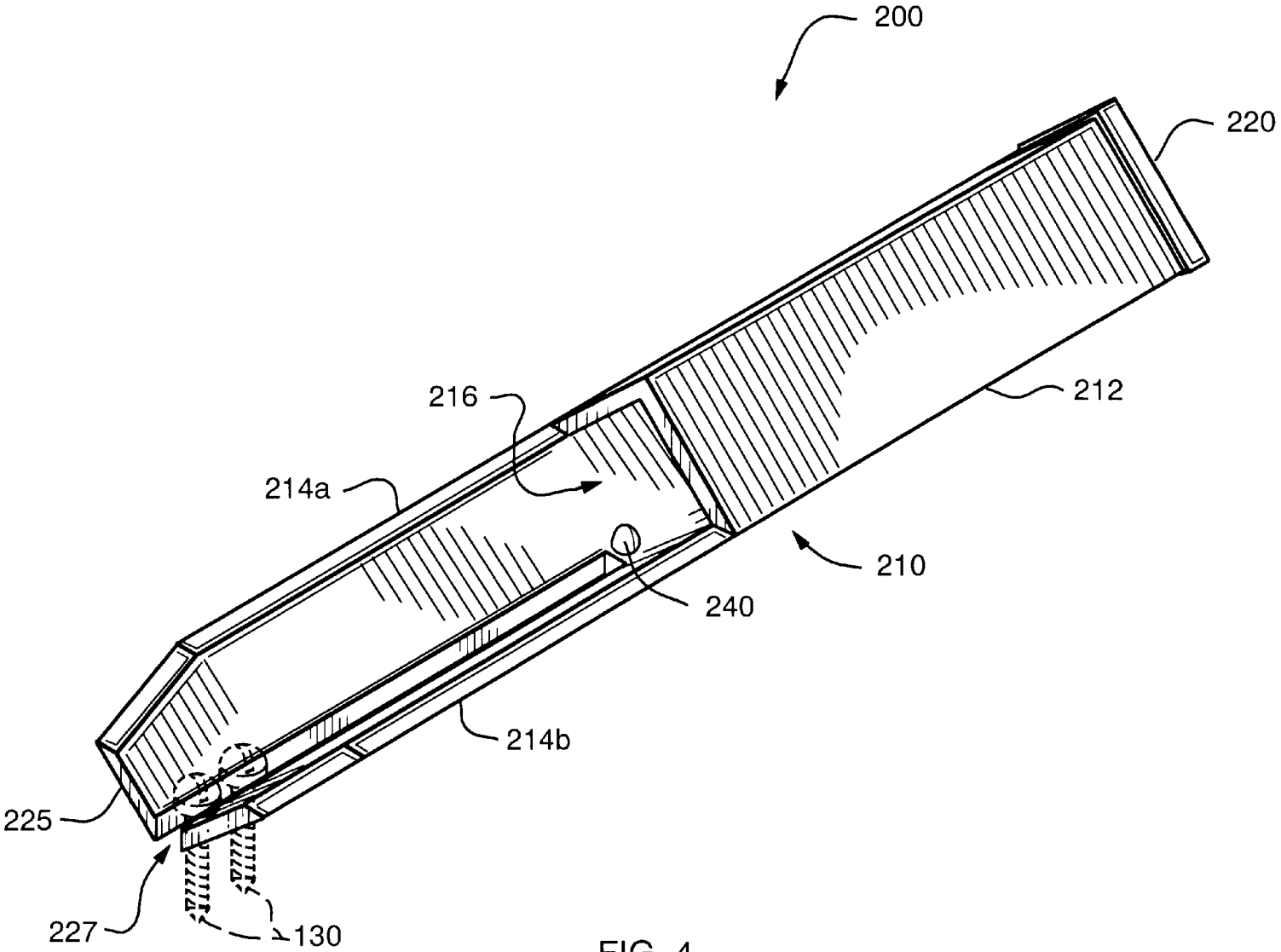
FIG. 4 is an isometric view of a second embodiment of the invention having a wedge-shaped feeding channel.
Figure 5:
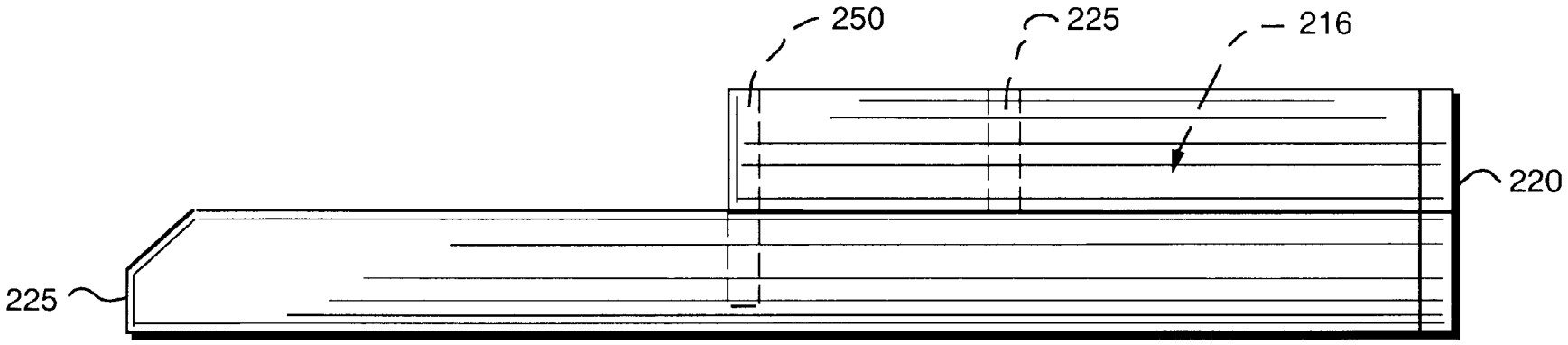
FIG. 5 shows the use of baffles to restrict the flow of fasteners within the feeder.

Refer now to FIG. 4, which illustrates a second embodiment of the invention indicated generally at 200. The feeder 200 comprises an angled, elongated member 210 having a handle portion 212 and a channel portion 214 defined by a pair of angled side walls 214*a,* 214*b.* Channel portion 214 has a wedge- or V-shaped transverse cross-section, while handle portion 212 is square or rhomboid. Handle 212 forms a closed reservoir 216 having a hollow interior terminated by an end face or cap 220 (which may or may not be removable). Channel 214 has a free end 225 and a slit 227 extending longitudinally from the free end 225 along the corner formed by joinder of side walls 214*a,* 214*b.*

The pronounced channel slope afforded by this embodiment causes fasteners to align themselves more readily along the longitudinal axis of channel 214 for easier penetration through slit 227. At the same time, however, this shape may also encourage excessive or uneven fastener flow from reservoir 216. One approach to regulating the flow of fasteners is the provision of a small obstruction or projection 240 just past the interior terminus of slit 227. This impedes the mass of fasteners from sliding out of reservoir 216.

Additionally or in lieu of such an obstruction, it is possible to add one or more baffles 250, 255 within the hollow of reservoir 216 to prevent bulk movement of fasteners. These baffles 250, 255 depend transversely from the upper interior walls of handle portion 210, their extent determining the amount of restriction. For very small fasteners, where bulk movement is significant, a baffle 250 extending below the central axis of handle portion 210 may be desirable. In this case, loading may be conveniently accomplished through removal of end face 220.

It is of course possible to combine features of the two embodiments thus far described. For example, handle portion 210 can be rounded as shown in FIG. 1 for greater handling comfort, while one or more baffles 250, 255 and/or an obstruction 240 can be added to the first embodiment 100 to relieve the user of the need to manually restrict the flow of fasteners. Addition of an obstruction 240 is especially useful in connection with large-diameter feeders that accommodate sizable fasteners, and which prevent ready thumb or finger access to reservoir 116.

Figure 6:
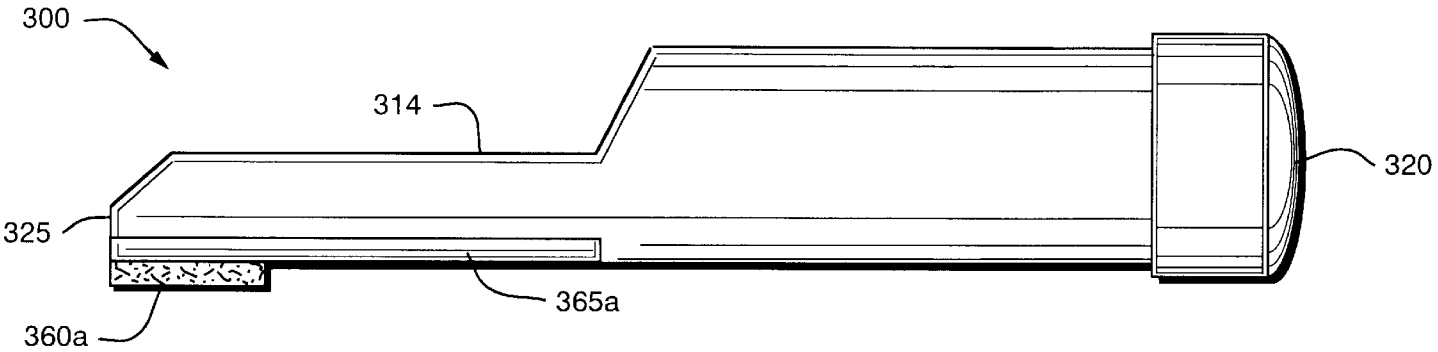
FIG. 6 is a side elevation of an embodiment of the invention adapted to feed nails.
Figure 7A:
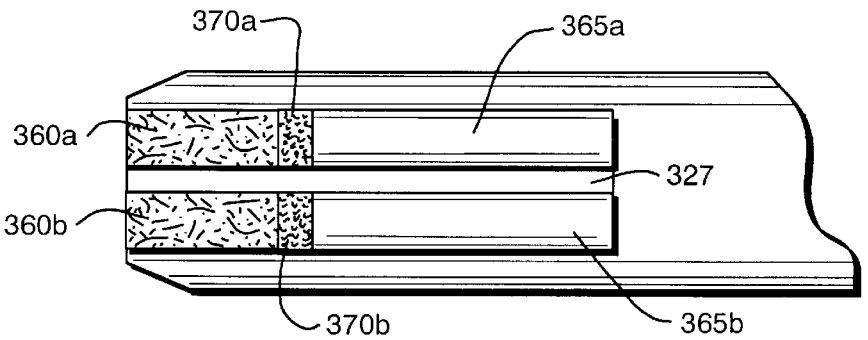
FIGS. 7A and 7B are bottom plan views of the embodiment shown in FIG. 6, emphasizing the guide pads used to retain fasteners such as nails.
Figure 7B:
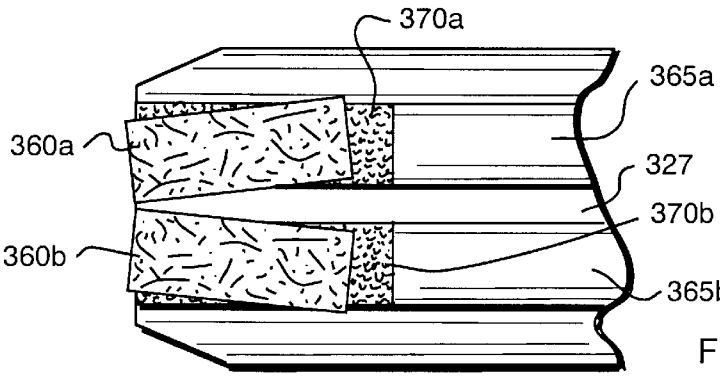
Figure 8:
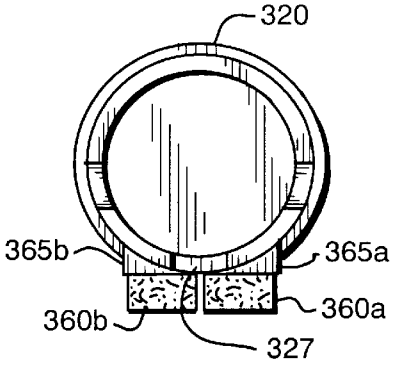
FIG. 8 is an end view of the embodiment shown in FIG. 6.

Refer now to FIGS. 6–8, which illustrate an embodiment 300 of is the invention particularly suited to feeding nails and similar fasteners driven with a hammer. For such fasteners, convenient installation requires the head to be raised above the surface of the feeder channel so they may be struck cleanly without damage to the feeder. Accordingly, an arrangement is employed whereby the lead nail is removably retained at the exit from slit 327, allowing the head to be raised above the level of slit 327 without the nail exiting the feeder 300. This arrangement comprises a pair of flexible pads 360*a,* 360*b* which, as shown in FIG. 7B, are angled toward one another so as to progressively restrict slit 327 toward the free end. Pads 360*a,* 360*b* meet at the free end of slit 327, impeding the progress of the lead nail, but allowing a partially driven nail to pass when the user pulls feeder 300 away.

For maximum contact between pads 360*a,* 360*b* and the shank of a nail, the pads are preferably disposed parallel to one another on the same horizontal plane, placing the thickness of the pad edges parallel to the shanks of nails extending through slit 327 as shown in FIG. 8. Accordingly, pads 360*a,* 360*b* are preferably carried on a pair of shoulders 365*a,* 365*b* molded into or affixed to the underside of channel 314 to present parallel mounting surfaces for receiving pads 360*a,* 360*b*. Although the pads are mounted near free end 325 and may be relatively short, shoulders 365*a,* 365*b* may be longer then necessary—e.g., running along the entire length of slit 327—in order to confer additional strength to the device.

Flexible pads 360*a,* 360*b* are preferably soft foam strips; however, other frictional or compressible materials, such as bristle brushes, may also be used. As shown in FIGS. 7A and 7B, pads 360*a,* 360*b* may be attached to the flat undersides of shoulders 365*a,* 365*b* by means of complementary strips of a hook-and-pile material, such as VELCRO. This arrangement allows the user to set the degree of restriction, replace the pads when necessary, and interchange the pads as appropriate (for example, long nails may require thicker strips). For example, as shown in FIG. 7A, the device 300 may be supplied with a pair of pads 360*a,* 360*b* backed with a hook-and-pile material affixed to a pair of complementary hook-and-pile strips 370*a,* 370*b*. The user is free to manipulate pads 360*a,* 360*b* along strips 370*a,* 370*b* to obtain a desired degree of restriction, as shown in FIG. 7B.

It will therefore be seen that I have developed a conveniently employed and inexpensively manufactured device for feeding a variety of fasteners. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A hand-held feeder for fasteners of the type having a head and a shank, the feeder comprising a (i) handle configured to contain said fasteners, (ii) a channel extending from the handle, the channel having a free end and a slit extending from the free end toward the handle, the slit being wider than said shank but narrower than said head, and (iii) means for removably retaining a fastener at the free end of the channel, the channel having an open portion providing unobstructed overhead access to the heads of fasteners engaged within the retaining means and having shanks extending through the slit.

2. The feeder of claim 1 wherein the handle has a hollow interior and an open end.

3. The feeder of claim 2 wherein the handle also has a closed end and a longitudinal axis extending between the ends.

4. The feeder of claim 3 wherein the channel has opposite side edges that define a plane that is at or close to the axis.

5. The feeder of claim 3 wherein the handle comprises at least one transversely oriented baffle between the ends.

6. The feeder of claim 1 wherein the slit is at a bottom of the channel.

7. The feeder of claim 1 wherein the channel has an arcuate transverse cross-section.

8. The feeder of claim 1 wherein the channel has a V-shaped transverse cross-section.

9. The feeder of claim 8 wherein the slit has a terminus and further comprising a raised obstruction near the terminus.

10. The feeder of claim 1 wherein the slit extends substantially the entire length of the channel.

11. The feeder of claim 1 wherein the retaining means comprises means for narrowing the slit toward the free end.

12. The feeder of claim 11 further comprising an exterior surface, the narrowing means comprising a pair of flexible pads disposed on the exterior surface beneath the slit, the pads being angled toward one another to progressively restrict the slit.

13. The feeder of claim 12 further comprising a pair of shoulder members carried on the exterior surface and disposed alongside and parallel to the slit, the shoulder members having parallel mounting surfaces for receiving the flexible pads.

14. The feeder of claim 13 wherein the mounting surfaces and the pads comprise a hook-and-pile material for attachment.

* * * * *